US009661955B1

(12) United States Patent
Sampair et al.

(10) Patent No.: US 9,661,955 B1
(45) Date of Patent: May 30, 2017

(54) DRAIN PLUG KIT WITH BUOYANT DRAIN PLUG PULL CORD

(71) Applicants: Peter Joseph Sampair, Mahtomedi, MN (US); Judd Alan Jackson, Grant, MN (US); Marta Van Develde McCormack, Centerville, MN (US)

(72) Inventors: Peter Joseph Sampair, Mahtomedi, MN (US); Judd Alan Jackson, Grant, MN (US); Marta Van Develde McCormack, Centerville, MN (US)

( * ) Notice: Subject to any disclaimer, the term of this patent is extended or adjusted under 35 U.S.C. 154(b) by 47 days.

(21) Appl. No.: 14/470,480

(22) Filed: Aug. 27, 2014

Related U.S. Application Data

(60) Provisional application No. 61/870,296, filed on Aug. 27, 2013.

(51) Int. Cl.
*A47K 1/14* (2006.01)

(52) U.S. Cl.
CPC ..... *A47K 1/14* (2013.01)

(58) Field of Classification Search
CPC ..... A47K 1/14
USPC ..... 4/286–295
See application file for complete search history.

(56) References Cited

U.S. PATENT DOCUMENTS

| | | | | |
|---|---|---|---|---|
| 4,779,640 | A * | 10/1988 | Cummings | F16T 1/20 137/195 |
| 4,930,657 | A | 6/1990 | Walker | |
| 5,636,390 | A * | 6/1997 | Strech | A47K 1/14 4/286 |
| 6,732,385 | B1 * | 5/2004 | Henderson | A47K 1/14 4/295 |
| 7,316,195 | B2 | 1/2008 | DeHart | |
| 8,499,376 | B2 * | 8/2013 | Kyung Kim | E03C 1/2306 4/287 |
| 2008/0301868 | A1 | 12/2008 | Libit et al. | |
| 2012/0152950 | A1 | 6/2012 | Al-Subaiey | |

OTHER PUBLICATIONS

Floating Row Boat Soap Holder and Tub Plug: Home & Kitchen—http://www.amazon.com/Floating-Boat-Soap-Holder-Plug/dp/B001CE8BQ8/ref=sr_1_38?, Jun. 25, 2013.
Polar Bear Drain Stopper—http://www.coolstuffexpress.com/Polar-Bear-Drain-Stopper.html, Jun. 25, 2013.

* cited by examiner

*Primary Examiner* — Lori Baker
(74) *Attorney, Agent, or Firm* — Sherrill Law Offices, PLLC

(57) ABSTRACT

A drain plug kit and method of using the drain plug. The kit includes a buoyant member, a drain plug; and a biasing member configured and arranged to interconnect the buoyant member and the drain plug with biasing of the buoyant member towards the drain plug.

11 Claims, 25 Drawing Sheets

DRAIN PLUG KIT WITH BUOYANT DRAIN PLUG PULL CORD

BACKGROUND

There are many types or drain plugs or stoppers for sinks, tubs and other liquid containing vessels with drain holes. Some of the drain plugs or stoppers have stems to allow the plug or drain to be easily removed from the drain hole. Other drain plugs or stoppers have pull cords attached to the stopper or plug to be pulled on to help remove the plug or stopper from the drain hole. Both methods of removing the drain or plug require a person to insert their hand into the water to remove the drain or plug by pulling the stem or pull cord. This water can be dirty or at extreme temperatures uncomfortable or harmful to a person's skin.

A buoyant object can be attached to the pull cord to provide a means for locating and pulling the end of the cord without inserting a hand into the water. The pull cord is attached using a retention clip through a hole in the stem of the drain stopper. A special stopper needs to be purchased that has a chain attached or has a hole through the stem to attach a pull cord. When out of the water the chain can get tangled with other items. The buoyant object is free to float about the surface of the water. As its only limitation is the length of the chain, the buoyant object can accidently be pulled out of the water as it floats about the surface of the water.

A need exists for a drain plug or stopper that can be removed from a sink of water without having to reach into the water to grab the plug or stopper and stays near the center of the body of water to limit accidental removal from the drain hole. A need also exists for a means to adapt a drain plug to accommodate a buoyant pull cord.

DETAILED DESCRIPTION OF A PREFERRED EMBODIMENT

Definitions

Figure 1:
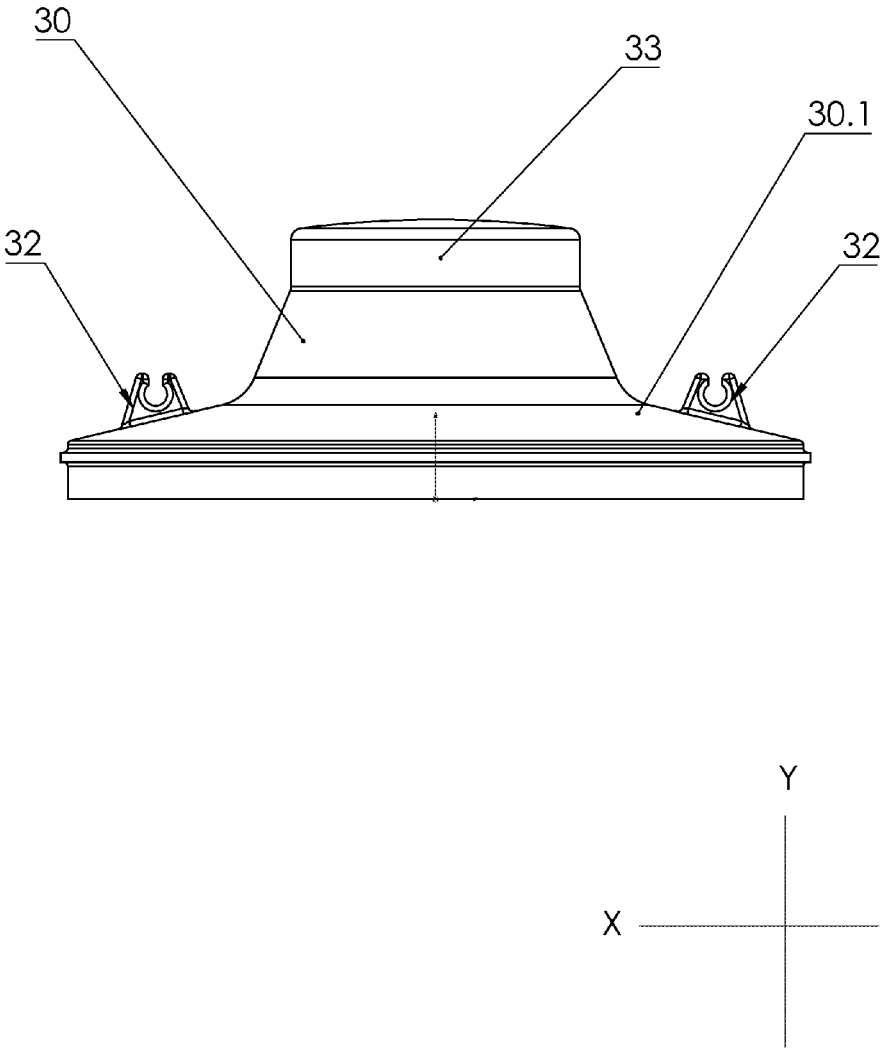
FIG. 1 is a side view of the one embodiment of the drain plug of the invention.

As utilized herein, the phrase "snap-fit" means a mechanical joint system where a flexible locking feature moves to allow engagement with a mating part followed by return of the locking feature toward its original position to accomplish latching the components together.

Nomenclature

10 Drain plug kit
20 Buoyant member
21 Surface
22 Indicia
23 Scouring pad
30 Drain Plug
$30_1$ or 30.1 First surface
$30_2$ or 30.2 Second surface
32 Retention clip
33 Stem
34 Suction cup
40 Biasing member
41 First end
42 Second end
50 Adapter member
51 Retention clip
52 Locking tab
53 Aperture
54 Surface
60 Attachment means
X Longitudinal direction
Y Lateral direction
Y1 Lateral axis of biasing member
Y2 Lateral axis of adapter member

Construction

The present described invention is a drain plug kit 10 with a buoyant drain plug pull cord. One embodiment of the kit 10 contains a buoyant member 20, a drain plug 30, and a biasing member 40. A second embodiment of the kit 10 contains a buoyant member 20, a biasing member 40 and an adapter member 50.

First Embodiment

Figure 2:
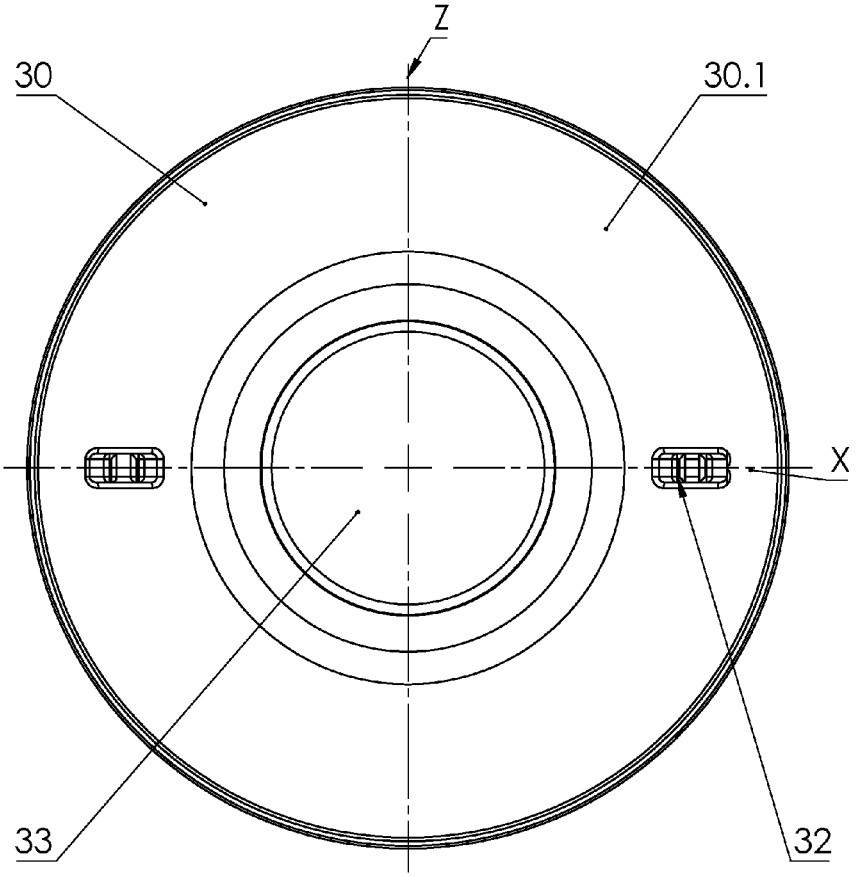
FIG. 2 is a top view of the drain plug depicted in FIG. 1.
Figure 3:
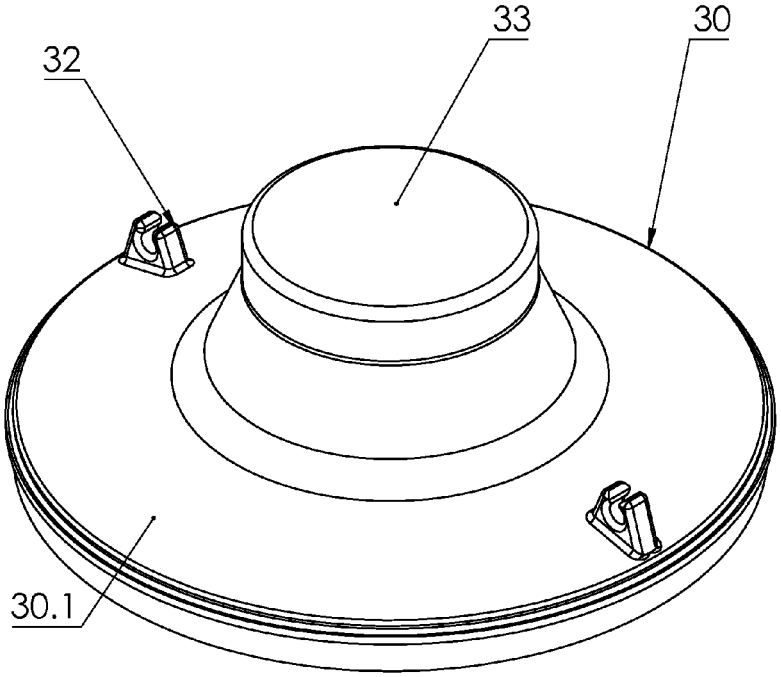
FIG. 3 is a top perspective view of the drain plug depicted in FIG. 2.

Referring to FIGS. 1-3, the drain plug 30 has a first surface $30_1$ and a second surface $30_2$ and is configured and arranged to open and close a drain hole in a sink, tub or other liquid holding vessel (not shown). The first surface $30_1$ is the surface visible when the drain plug 30 is inserted into a drain hole to close the drain. A stem 33 may laterally Y project from the first surface $30_1$. Preferably the stem 33 is longitudinally X and transversely Z centered on the first surface $30_1$.

The drain plug 30 has an attachment means 60 on the first surface $30_1$. Preferably the attachment means 60 is at least one retention clip 32. Most preferably there are two retention clips 32 longitudinally X or transversely Z spaced on either side (not numbered) of the stem 33. Any suitable type of retention clip 32 may be used such as an open clip or a closable clip.

Referring to FIGS. 23-26, a second embodiment of the drain plug 30 has a first surface $30_1$ and a second surface $30_2$ and is configured and arranged to open and close a drain hole in a sink, tub or other liquid holding vessel (not shown). The first surface $30_1$ is the surface visible when the drain plug 30 is inserted into a drain hole to close the drain. A suction cup 34 may laterally Y project from the second surface $30_2$ for use in releasably securing the drain plug 30 to a nonporous vertical surface, such as the sidewall of a sink, when not in use.

Figure 4:
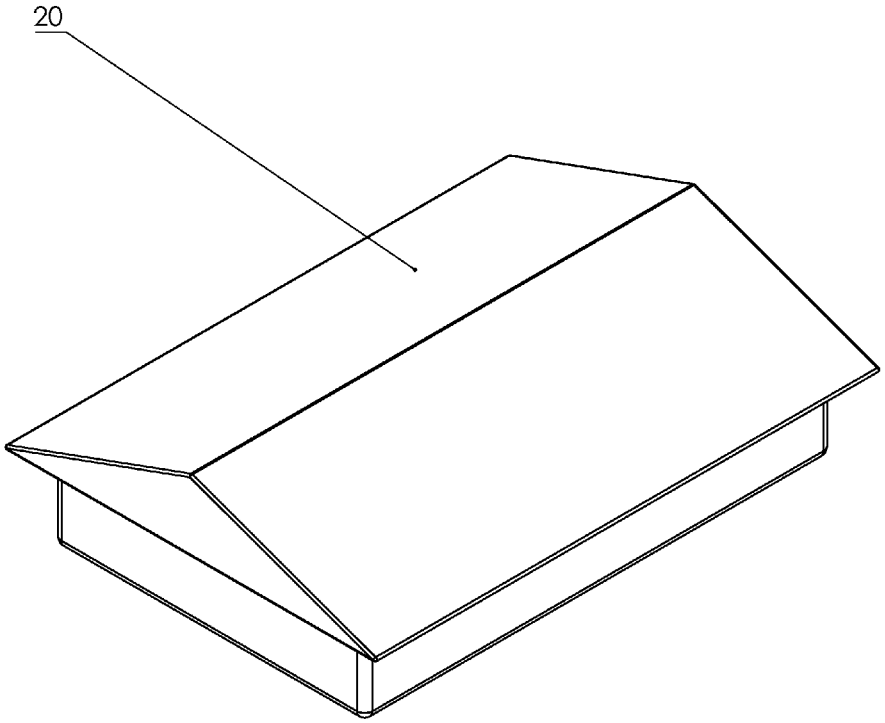
FIG. 4 is a top perspective view of one embodiment of the buoyant member of the invention.
Figure 5:
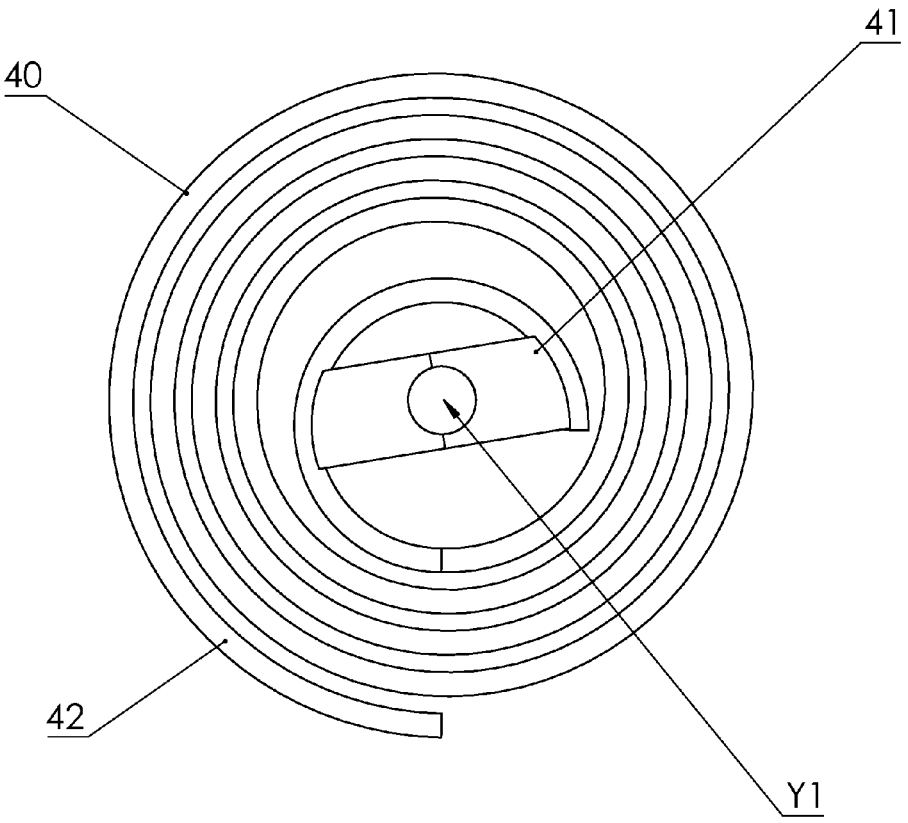
FIG. 5 is a top view of one embodiment of the biasing member of the invention in the collapsed position.
Figure 18:
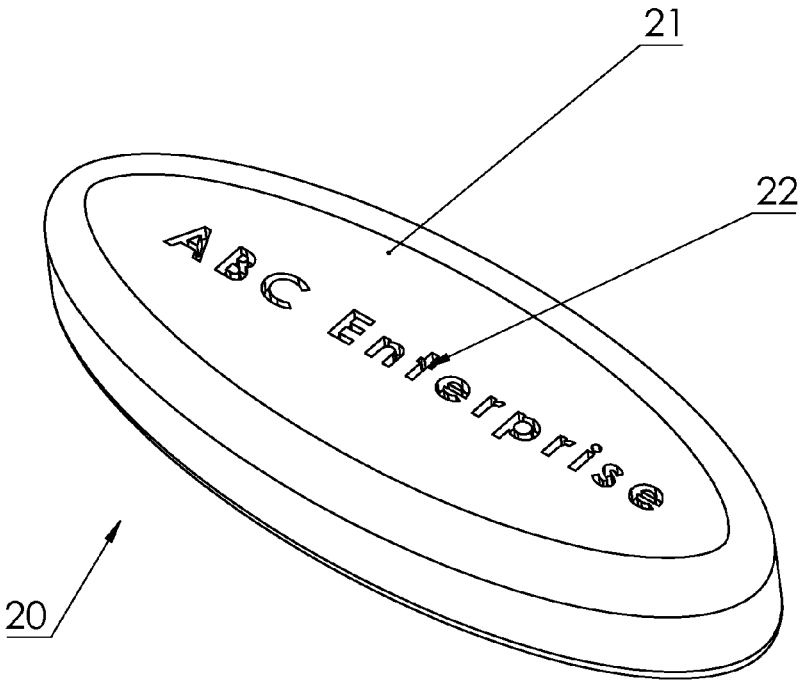
FIG. 18 is a top perspective view of a second embodiment of the buoyant member with indicia on a surface.
Figure 19:
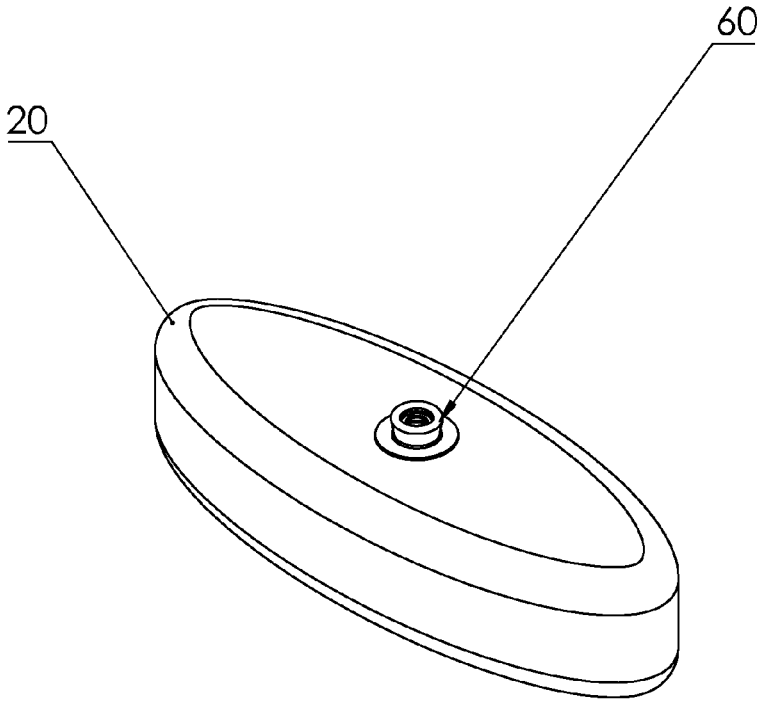
FIG. 19 is a bottom perspective view of the buoyant member in FIG. 18.
Figure 20:
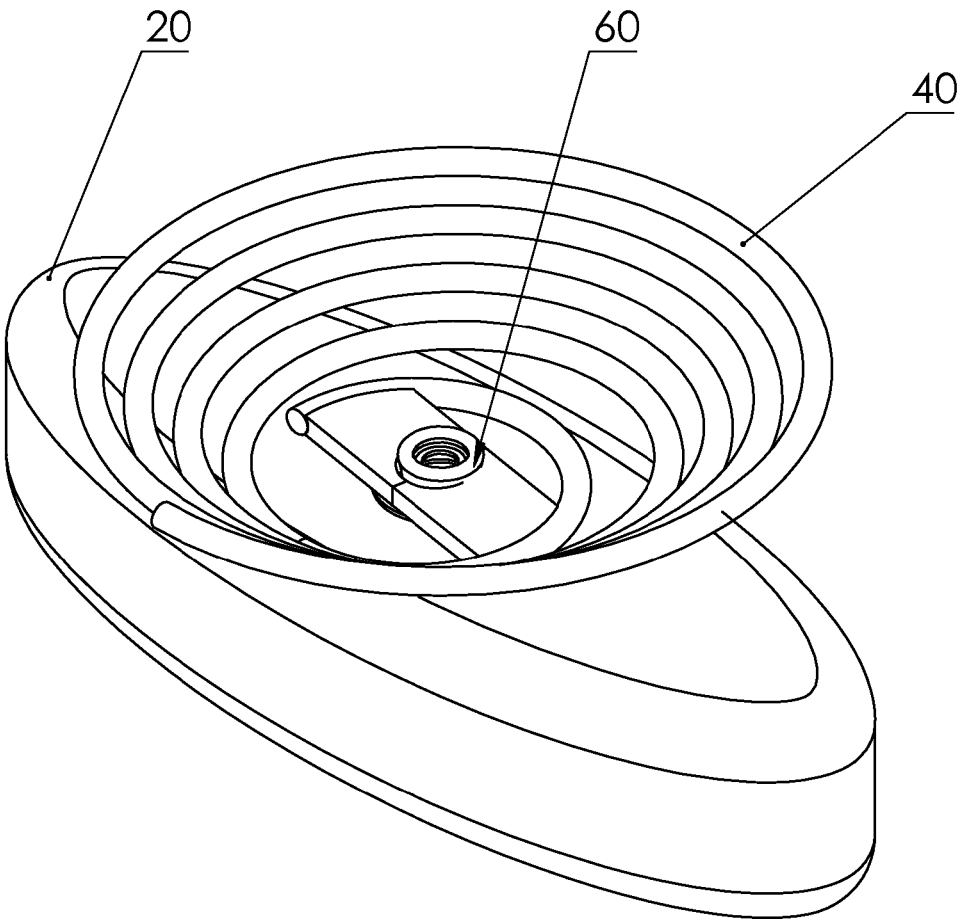
FIG. 20 is a bottom perspective view of the buoyant member in FIG. 19 attached to the biasing member in FIG. 17.
Figure 21:
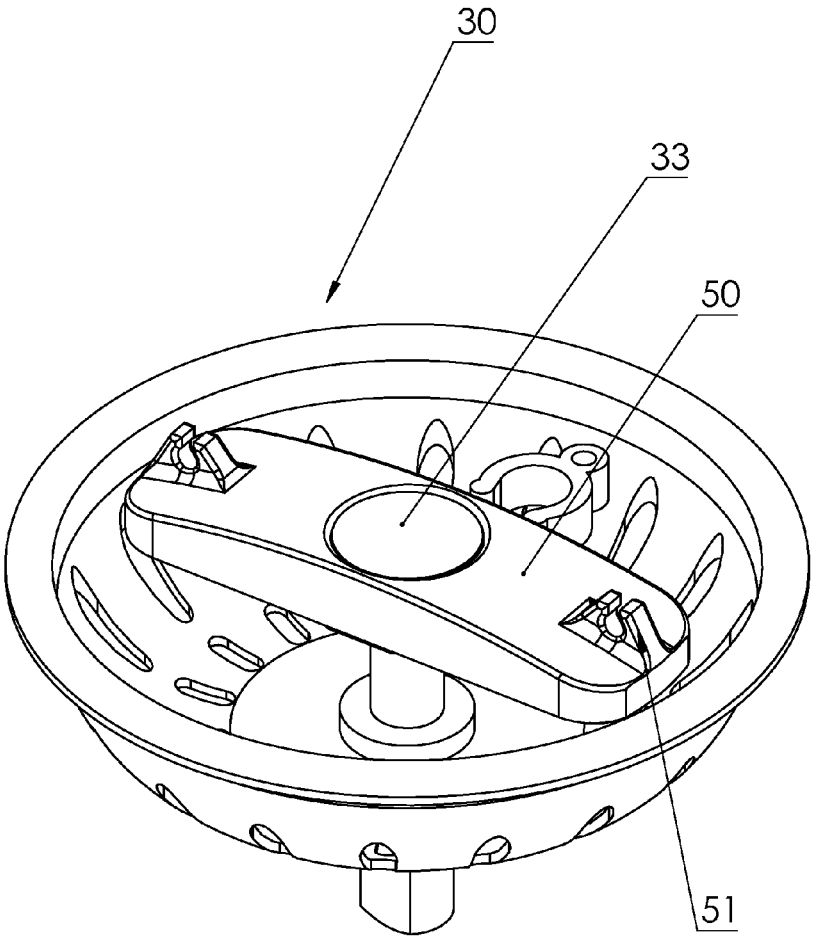
FIG. 21 is a top perspective view of the adapter member depicted in FIG. 11 snap-fitted onto the stem of a second embodiment of the drain plug.
Figure 22:
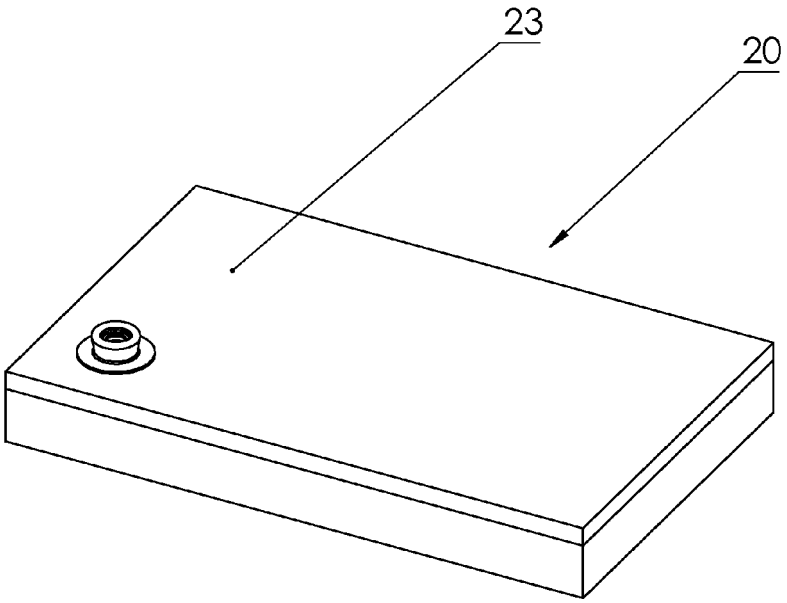
FIG. 22 is a bottom perspective view of a third embodiment of the buoyant member with a scouring pad attached to at least one surface.
Figure 23:
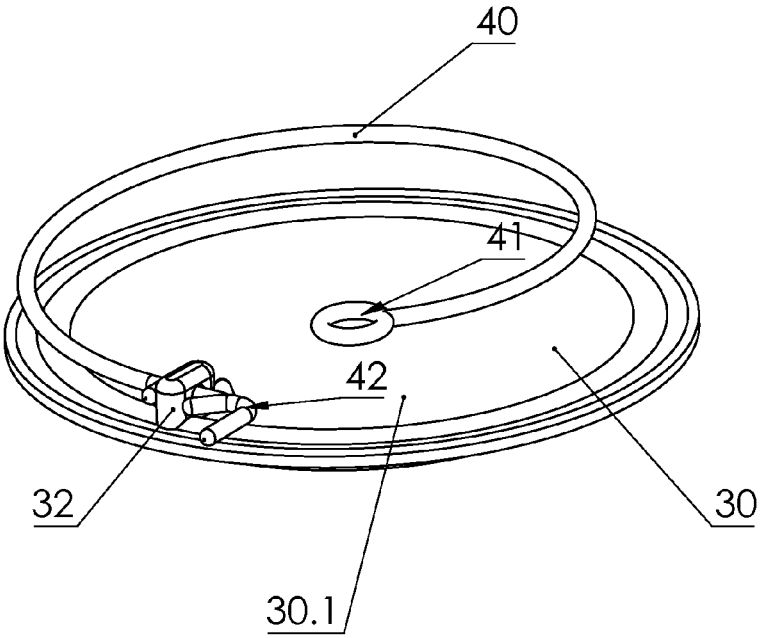
FIG. 23 is a top perspective view of another embodiment of the drain plug with attached biasing means of the invention.
Figure 24:
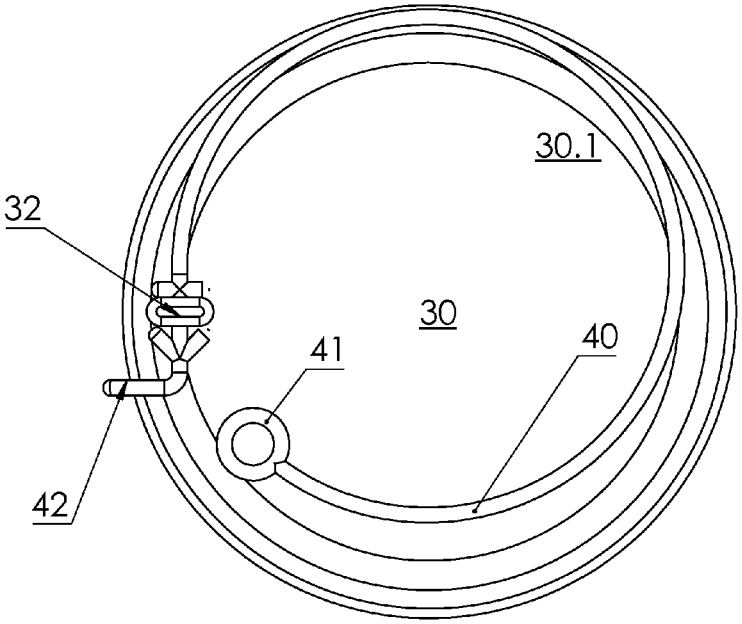
FIG. 24 is a top view of the drain plug with attached biasing means depicted in FIG. 23.
Figure 25:
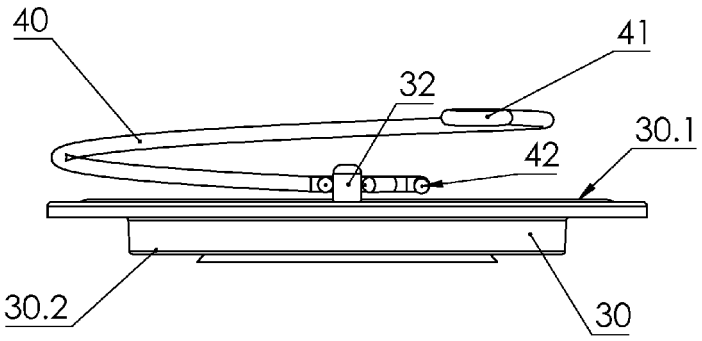
FIG. 25 is a side view of the drain plug with attached biasing means depicted in FIG. 23.
Figure 26:
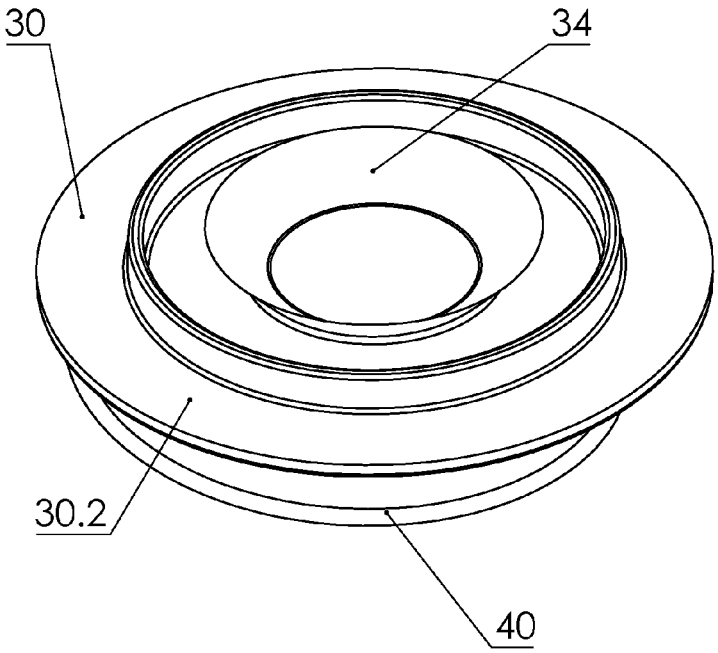
FIG. 26 is a bottom perspective view of the drain plug with attached biasing means depicted in FIG. 23.

The buoyant member 20 may be any suitable buoyant object that is configured and arranged to float on water (not shown) if untethered from the drain plug 30. But, the buoyant member 20 is configured and arranged to be ineffective for automatically seating or unseating the drain plug 30 from a drain hole when tethered to the drain plug 30. The buoyant member 20 may be made of any suitable material such as foam, sponge, Styrofoam, wood, or a gas filled member. The preferred materials are foam or sponge. The buoyant member 20 may be any desired shape or size. Preferably the size is relatively small in relation to the surface area of the water in the vessel to reduce the likelihood of the buoyant member 20 interfering with the use of the water to wash dishes or being inadvertently pulled out of the water yet large enough to allow easy gripping when needed to remove the buoyant member 20 from the water. Examples of shapes are shown in FIGS. 4 and 18. The buoyant member 20 may also have indicia 22 on at least one surface 21 as shown in FIG. 18 to advertise a company's products or services or to enhance the appearance of the drain plug kit 10. The buoyant member 20 may also have a scouring pad 23 attached to at least one surface 21 as shown in FIG. 22. The scouring pad 23 may then be used to clean items.

Figures 13, 14:
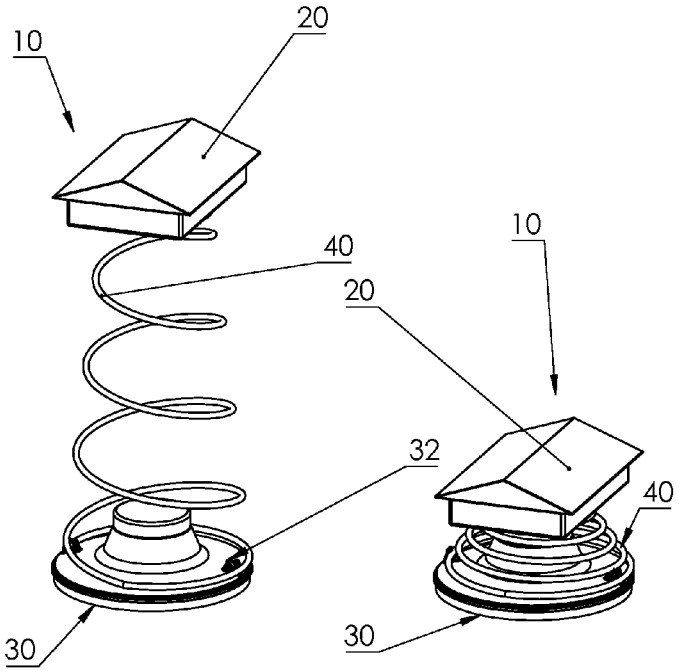
FIG. 13 is a top perspective view of the individual components of the invention depicted in FIGS. 1, 4, and 5 assembled and in the collapsed position.
FIG. 14 is a top perspective view of the assembled invention depicted in FIG. 13 in the extended position.

More than one buoyant member 20 may be tethered to the drain plug 30. For example, a first buoyant member 20 as shown in FIG. 14 may be tethered to the drain plug 30 and then a second buoyant member 20 made of a sponge and having a scouring pad 23 attached to at least one surface 21 also tethered to the drain plug 30 or the first buoyant member 20.

Figure 6:
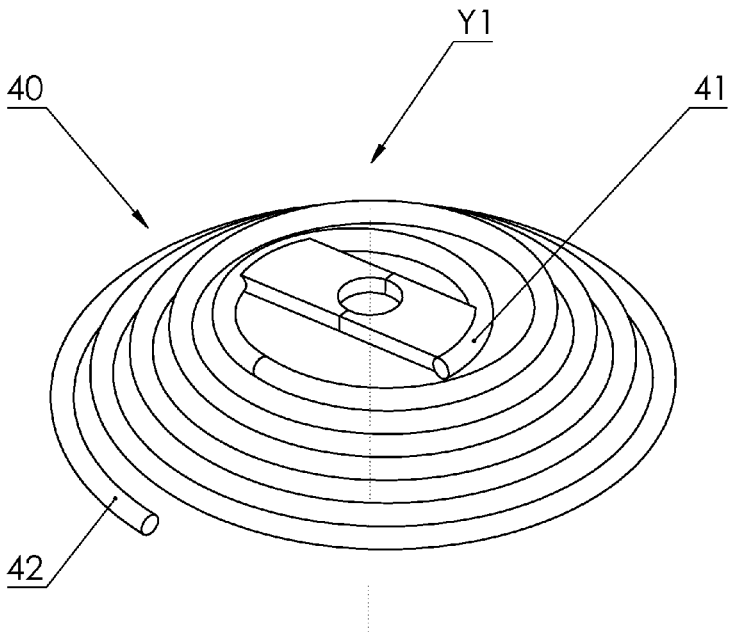
FIG. 6 is a top perspective view of the biasing member depicted in FIG. 5.
Figure 7:
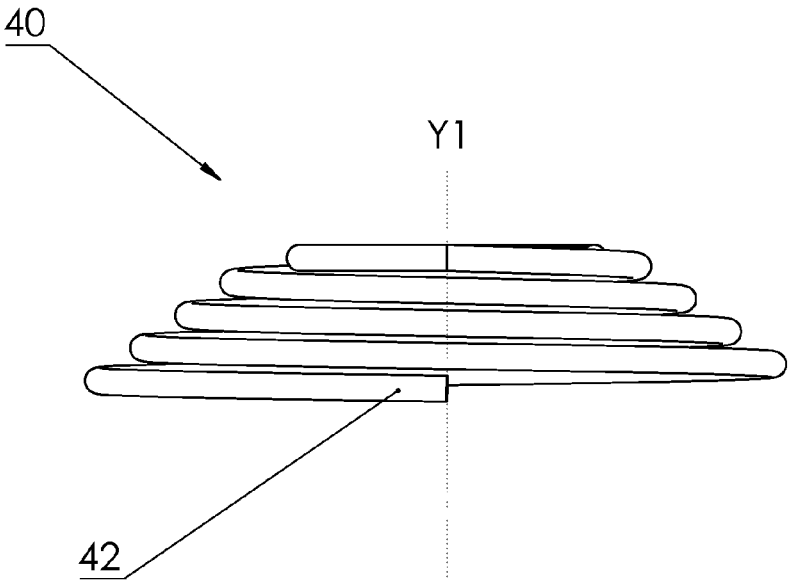
FIG. 7 is a side view of the biasing member depicted in FIG. 6.
Figure 8:
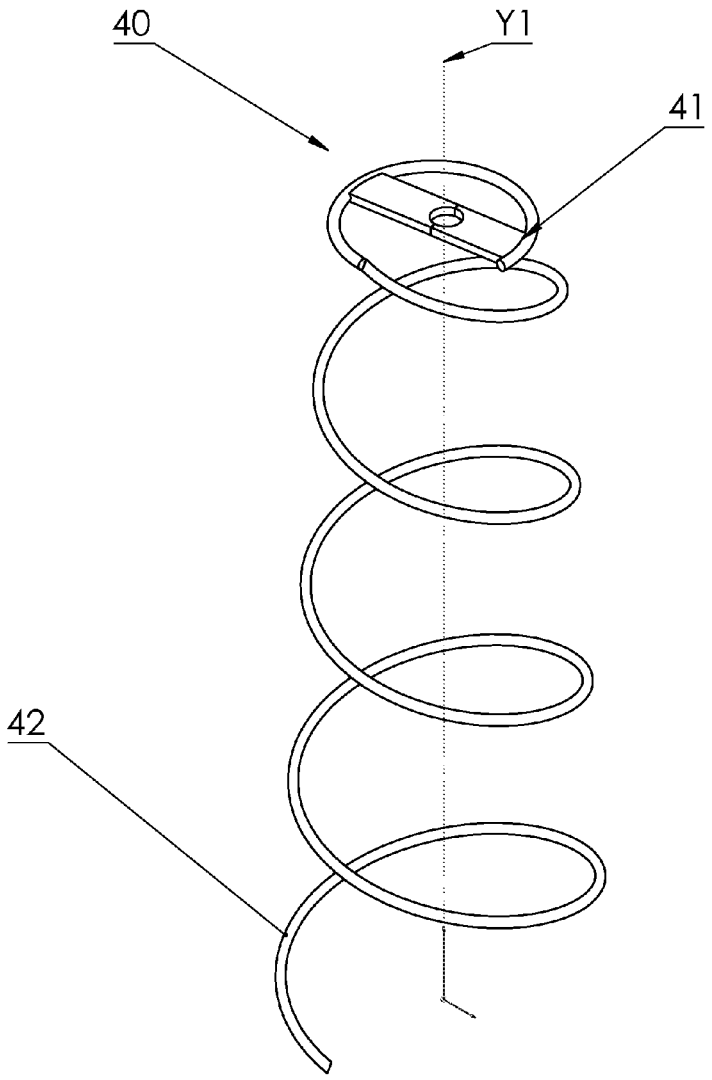
FIG. 8 is a top perspective view of the biasing member depicted in FIG. 5 in the extended position.
Figure 9:
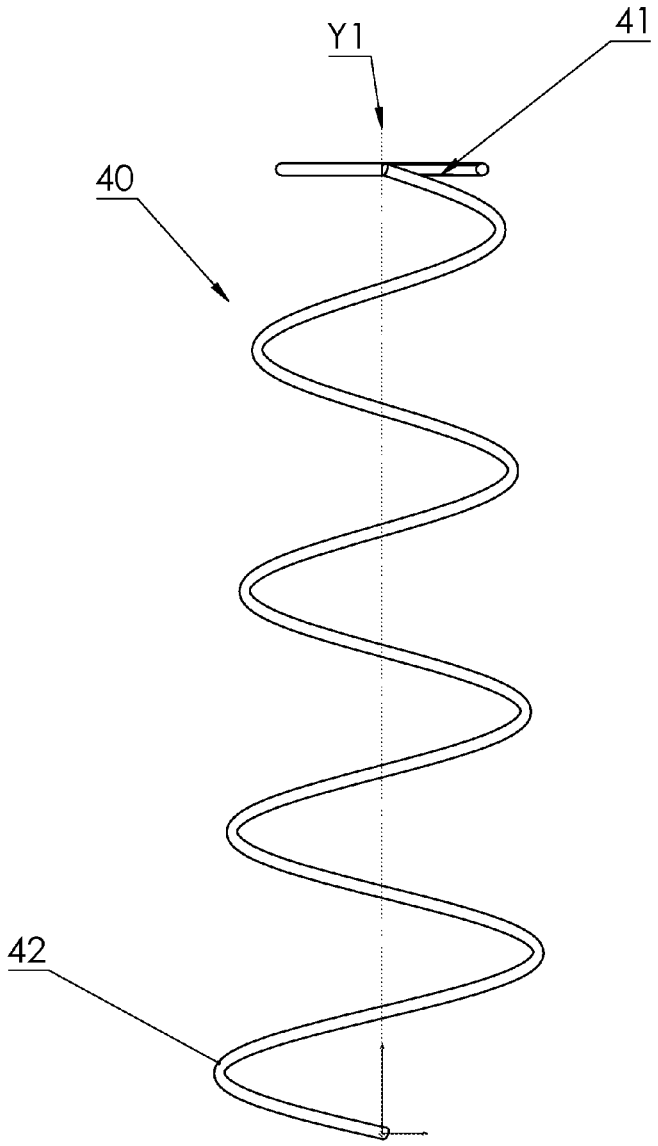
FIG. 9 is side view of the biasing member depicted in FIG. 7 in the extended position.
Figure 10:
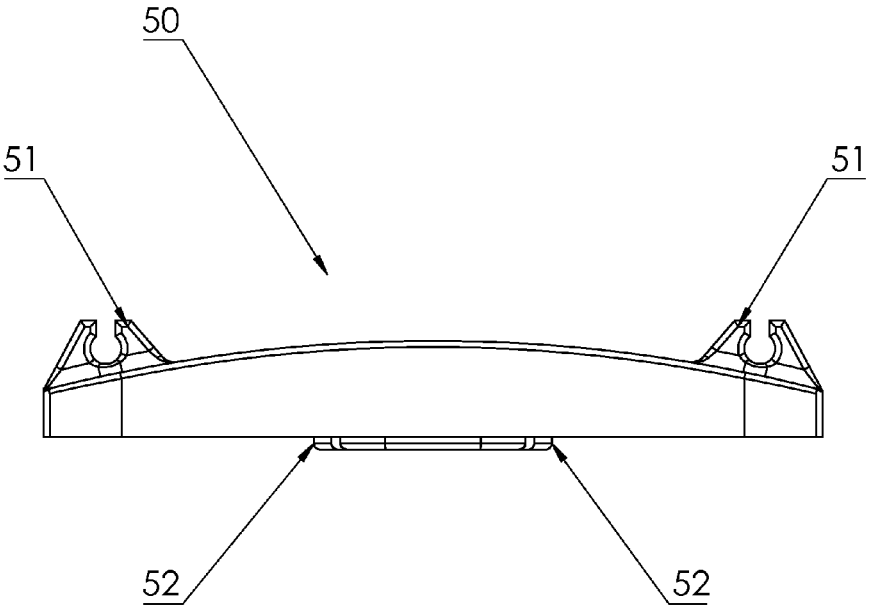
FIG. 10 is side view of on embodiment of the adapter member with two retention clips.
Figure 11:
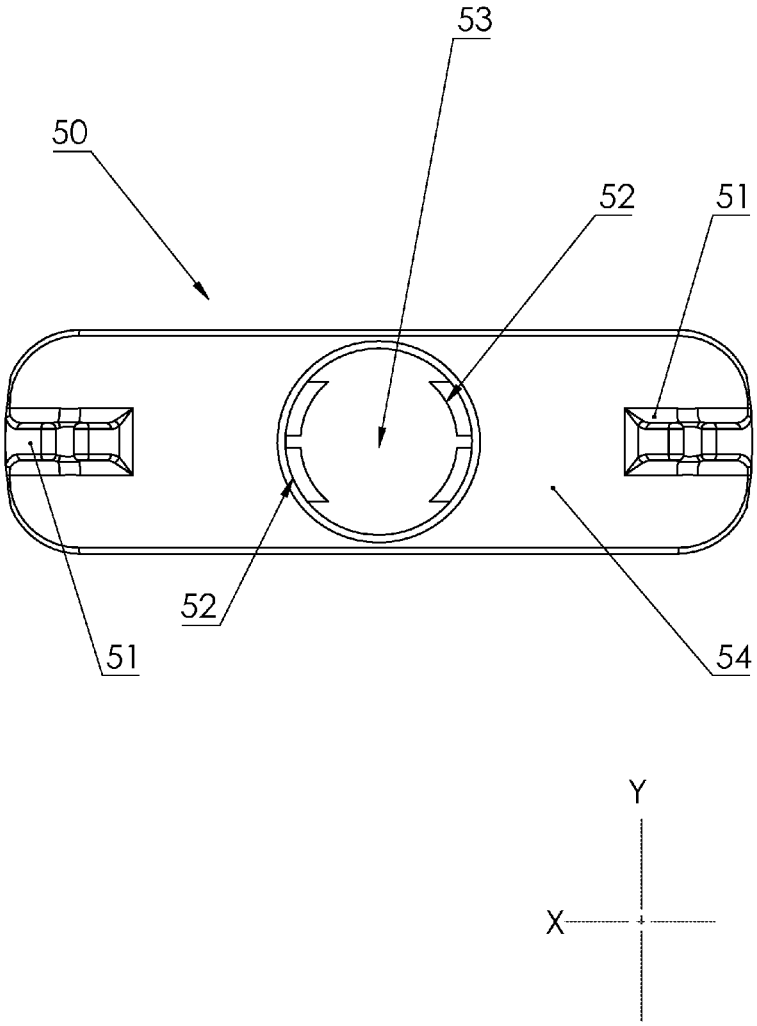
FIG. 11 is a top view of the adapter member depicted in FIG. 10.
Figure 12:
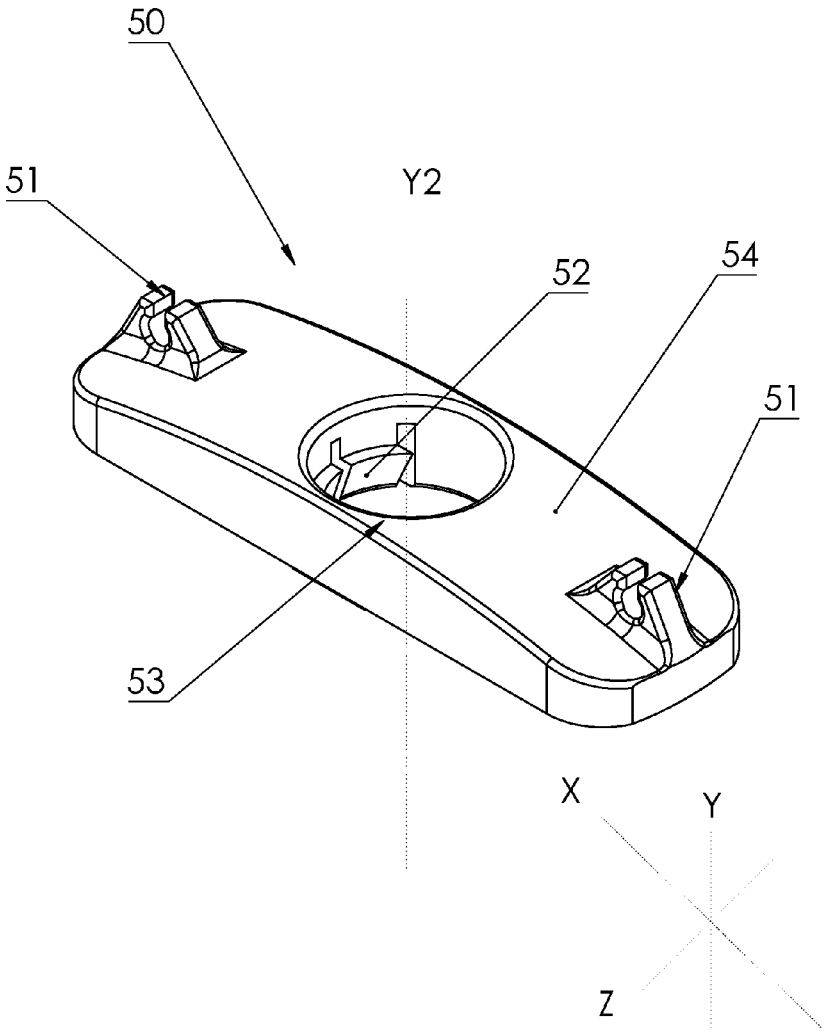
FIG. 12 is a top perspective view of the adapter member depicted in FIG. 11.

A biasing member 40 tethers the buoyant member 20 to the drain plug 30. As shown in FIGS. 5 and 23-25, the biasing member 40 has a first end 41 and a second end 42. Preferably, the biasing member 40 is biased toward a collapsed position as shown in FIGS. 5-7 and 23-25. The biasing member 40 may be any suitable biasing member 40 that is biased into a collapsed position such as a spring or a retractable cord. The biasing member 40 may be made from any suitable material such as metal or plastic. The biasing member needs a biasing force strong enough to return to a collapsed position outside of a liquid but not strong enough to overcome the buoyancy of the tethered buoyant member. The preferred biasing member 40 is a helical spring. The helical spring is not only biased in a collapsed position but is biased about a lateral axis Y1 while in the collapsed and extended positions as shown in FIGS. 6, 8, and 9. As shown in FIGS. 13 and 14 the lateral bias may help keep the buoyant member 20 centered over the lateral axis Y1 of the biasing member 40 to reduce the chances of the buoyant member 20 interfering with the use of the water in the vessel.

The first end 41 of the biasing member 40 is configured and arranged to attach to the buoyant member 20. The first end 41 may be integrally formed with the buoyant member 20, fixedly attached, or removably attached. Removable attachment is preferred. The removable attachment means 60 may be any suitable fastener such as a snap fastener, clip, clasp, retaining ring, threaded fastener or any other similar fastener. As shown in FIGS. 16, 17, 19 and 20, the snap fastener is preferred.

The second end 42 of the biasing member 40 is configured and arranged to attach to the first surface $30_1$ of the drain plug 30. The second end 42 may be integrally formed with, fixedly attached to, or removably attached to the first surface $30_1$ of the drain plug 30. As shown in FIGS. 13 and 14 the preferred biasing member 40 second end 42 is removably attached to the drain plug 30. Any suitable attachment means 60 can be used to attach the biasing member 40 to the drain plug 30. The preferred removable attachment means 60 is a retention clip 32. As shown in FIGS. 1-3 and 23-25 the drain plug 30 may have one or more retention clips 32 on the first surface $30_1$ to removably engage the second end 42 of the biasing member 40.

The biasing member 40 is configured and arranged to expand into an extended position when the second end 42 attached to the drain plug 30 is secured in a drain hole and the first end 41 is attached to the buoyant member 20 floating toward the surface of water in the sink, tub, or other vessel of water.

Second Embodiment

Figure 15:
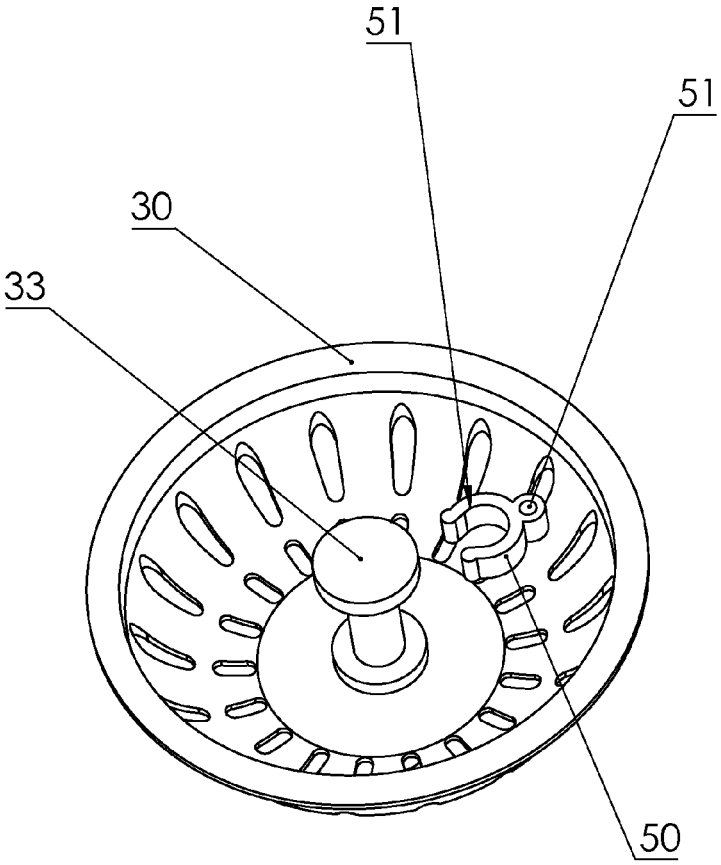
FIG. 15 is a top perspective view of another embodiment of the drain plug and the adapter member.
Figure 16:
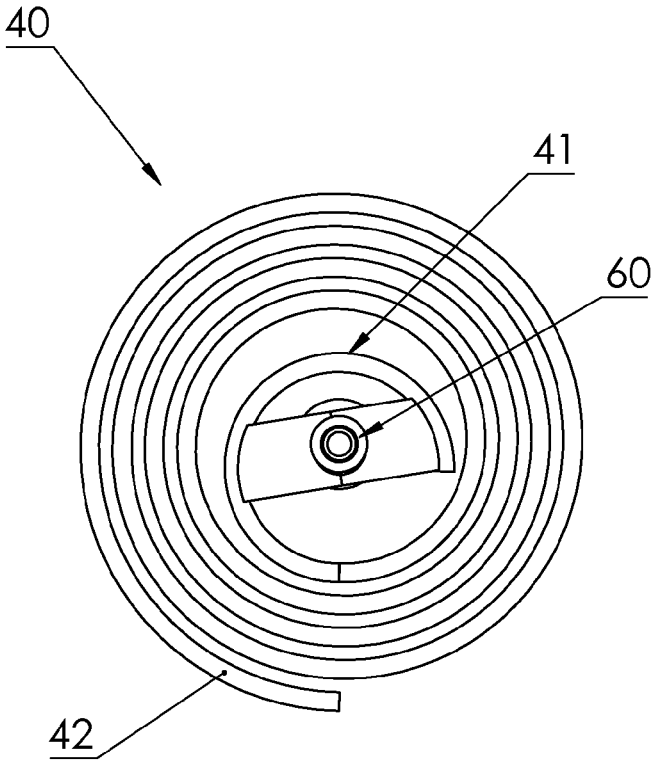
FIG. 16 is a top view of the biasing member in FIG. 5 with an attachment element.
Figure 17:
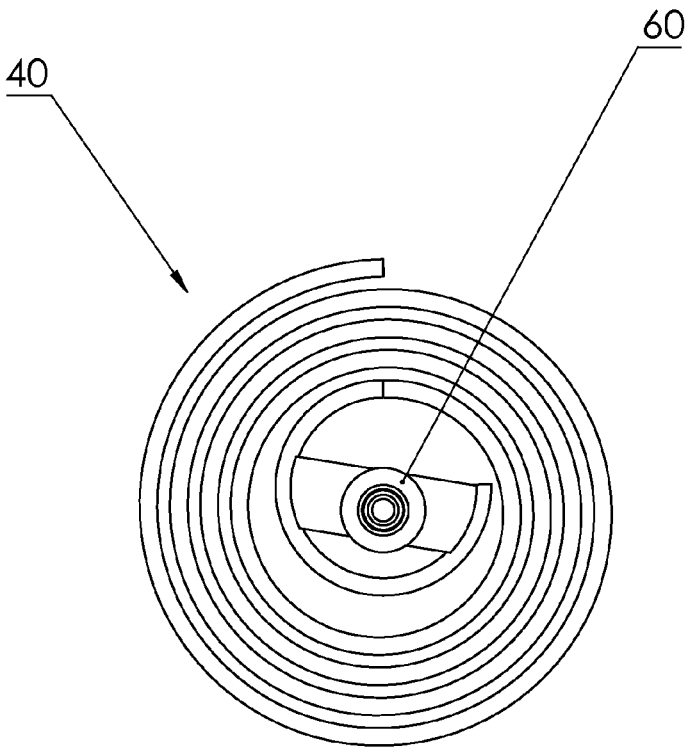
FIG. 17 is a bottom view of the biasing member in FIG. 16 with the attachment element.

If the biasing member 40 and buoyant member 20 are to be attached to an existing drain plug 30 not having a retention clip 32 or other attachment means 60 for the biasing member 40 then an adapter member 50 may be used to provide an attachment means 60 for the second end 42 of the biasing member 40. The adapter member 50 is configured and arranged to attach to the drain plug 30. Preferably the adapter member 50 is configured and arranged to attach to the stem 33 of the drain plug 30. As shown in FIG. 15 a first embodiment of the adapter member 50 has an open retention clip 51 configured and arranged to fit around the stem 33 on one end (not numbered) and a closed retention clip 51 on the other end configured and arranged to attach to the second end 42 of the biasing member 40. The biasing member 40 may also have a complementary retention clip 51 attached to or integrally formed in the second end 42.

A second embodiment of the adapter member is shown in FIGS. 10, 11, 12, and 21. The adapter member 50 is longitudinally X elongated with an aperture 53 extending laterally Y through the member 50 and configured and arranged to accommodate the passage of the stem 33 of the drain plug 30. Adapter members 50 may be provided with different sized apertures 53 to accommodate different sized drain plug stems 33. Preferably the aperture 53 is centered longitudinally X and laterally Y on the adapter member 50. At least two flexible locking tabs 52 extend radially into the aperture 53 about a lateral axis Y2 to provide a snap fit connection between the adapter member 50 and the stem 33. The adapter member 50 has two retention clips 51 formed in the surface 54 of the member 50 configured and arranged to releasably engage the second end 42 of the biasing member 40.

Use

The drain plug kit 10 may be used in a sink, tub, or other liquid containing vessel with a drain hole. The kit 10 contains at least a buoyant member 20, a biasing member 40, and a drain plug 30 or an adapter member 50. Preferably the kit 10 contains all four pieces.

First Kit Embodiment

A kit 10 having a buoyant member 20, a drain plug 30, and a biasing member 40 is obtained. As shown in FIG. 1, the drain plug 30 has at least one retention clip 32. The second end 42 of the biasing member 40 is attached to the drain plug 30 by the retention clip 32. Preferably the drain plug 30 has two retention clips 32 to attach the biasing member 40 to the drain plug 30 in two places to center the biasing member 40 over the drain plug 30 as shown in FIGS. 13 and 14. The first end 41 of the biasing member 40 is then attached to the buoyant member 20. The drain plug 30 is inserted into a drain hole of a vessel sealing the drain hole. As water is poured into the vessel the buoyant member 20 floats toward the surface of the water and pulls the biasing member 40 into an expanded position centered over the drain plug 30 as shown in FIG. 14. The buoyant member 20 floats toward the surface of the water until it rests on the top of the water or until the biasing member is fully extended. Once the water is no longer needed in the vessel the buoyant member 20 and biasing member 40 may be used as a pull cord to remove the drain plug 30 from the drain hole without touching the drain plug 30.

Second Kit Embodiment

A kit 10 having at least a buoyant member 20, a biasing member 40, and an adapter member 50 is obtained. The adapter member 50 is attached to the stem 33 of a drain plug 30. Any drain plug 30 with a stem may be used such as a strainer drain plug 30 or a disposal stopper. The second end 42 of the biasing member 40 is attached to the adapter member 50. The first end 41 of the biasing member 40 is attached to the buoyant member 20. If a helical spring is used for the biasing member 40, the lateral axis Y1 of the biasing member 40 laterally Y overlaps the lateral axis Y2 of the adapter member 50. This centers the biasing member 40 and the buoyant member 20 over the drain plug 30 in the collapsed position and the expanded position. The drain plug 30 is then inserted into a drain hole of a vessel sealing the drain hole.

We claim:

1. A drain plug kit comprising:

(a) a buoyant member;

(b) a drain plug; and (c) a biasing member configured and arranged to interconnect the buoyant member and the drain plug with biasing of the buoyant member towards the drain plug.

2. The drain plug kit of claim 1 wherein the drain plug includes a suction cup capable of suctioned supporting of a drain plug assembled from the drain plug kit on a nonporous vertical surface for storage.

3. The drain plug kit of claim 1 wherein the buoyancy of the buoyant member is sufficient to permit the buoyant member to float a vertical distance away from the drain plug against the biasing force of the biasing member when the drain plug is submerged below a layer of water.

4. The drain plug kit of claim 3 wherein the buoyancy of the buoyant member is insufficient to unseat the drain plug from a drain to which it has been sealingly engaged when the drain plug is submerged below a layer of water.

5. The drain plug kit of claim 1 wherein the biasing member is configured and arranged to removeably attach to the drain plug.

6. The drain plug kit of claim 1 wherein the first end of the biasing member is configured and arranged to removeably attach to the buoyant member.

7. The drain plug kit of claim 1 wherein the buoyant member has indicia on at least one surface.

8. The drain plug kit of claim 1 further comprising an adapter member configured and arranged to snap fit to a stem on the drain plug for interconnecting the biasing member to the drain plug.

9. The drain plug kit of claim 1 wherein the biasing member is a helical spring.

10. The drain plug kit of claim 1 wherein the buoyant member has a scouring pad on at least one surface.

11. A method of using a drain plug kit comprising the steps of:

(a) obtaining a drain plug kit of claim 1;

(b) assembling the drain plug kit to form an assembled drain plug;

(c) seating the drain plug component of the assembled drain plug into a drain hole of a sink;

(d) filling the sink with a layer of water whereby the float component of the assembled drain plug floats on the surface of the water and is thereby lifted away from the drain plug against the bias of the biasing member, and (e) unseating the drain plug component of the assembled drain plug from the drain hole by grasping the floating float component of the assembled drain plug and pulling upward.

* * * * *